US010060605B2

(12) United States Patent
Lan et al.

(10) Patent No.: US 10,060,605 B2
(45) Date of Patent: Aug. 28, 2018

(54) BENDABLE LED MODULE, CIRCULAR LED MODULE AND WAVY LED MODULE

(71) Applicant: GLUX VISUAL EFFECTS TECH (SHENZHEN) CO., LTD., Shenzhen (CN)

(72) Inventors: Xia Lan, Shenzhen (CN); Ming Lan, Shenzhen (CN); Yuancai Xu, Shenzhen (CN)

(73) Assignee: GLUX VISUAL EFFECTS TECH (SHENZHEN) CO., LTD., Shenzhen, Guangdong (CN)

( * ) Notice: Subject to any disclaimer, the term of this patent is extended or adjusted under 35 U.S.C. 154(b) by 244 days.

(21) Appl. No.: 14/900,872

(22) PCT Filed: Jul. 2, 2015

(86) PCT No.: PCT/CN2015/083144
§ 371 (c)(1),
(2) Date: Dec. 22, 2015

(87) PCT Pub. No.: WO2016/070636
PCT Pub. Date: May 12, 2016

(65) Prior Publication Data

US 2016/0369983 A1 Dec. 22, 2016

(30) Foreign Application Priority Data

Nov. 4, 2014 (CN) ..... 2014 1 0612968

(51) Int. Cl.
*F21V 19/02* (2006.01)
*G09F 9/33* (2006.01)
(Continued)

(52) U.S. Cl.
CPC ..... *F21V 19/02* (2013.01); *F21S 2/005* (2013.01); *F21S 4/22* (2016.01); *F21V 17/02* (2013.01);
(Continued)

(58) Field of Classification Search
CPC ..... F21S 4/22; F21S 2/005; H01L 51/0097; F21V 17/02; F21V 17/12
(Continued)

(56) References Cited

U.S. PATENT DOCUMENTS 6,401,404 B1 * 6/2002 Fillipp ..... B44C 5/00 362/249.04
8,262,250 B2 * 9/2012 Li ..... F21V 17/007 362/219
(Continued)

FOREIGN PATENT DOCUMENTS

CN 201188292 1/2009
CN 202549189 11/2012
(Continued)

OTHER PUBLICATIONS

Zhen et al., CN 104008707A, Published Aug. 27, 2014.*

*Primary Examiner* — William N Harris
(74) *Attorney, Agent, or Firm* — Hamre, Schumann, Mueller & Larson, P.C.

(57) ABSTRACT

The application discloses a bendable LED module, which comprises: an elastic component layer (20) on which a plurality of light emitting assemblies are arranged; an adjusting part (30) which acts on the back of the elastic component layer (20) and tightens or stretches the two sides of the elastic component layer (20), such that the elastic component layer (20) is bent into an inner arc or outer arc. After the elastic component layer (20) is bent and deformed, a larger
(Continued)

clearance or gap won't appear between the light emitting assemblies, which makes the display effect better.

8 Claims, 3 Drawing Sheets

(51) Int. Cl.

| | |
|---|---|
| ***G09F 9/302*** | (2006.01) |
| ***F21S 4/22*** | (2016.01) |
| ***F21S 2/00*** | (2016.01) |
| ***F21V 17/02*** | (2006.01) |
| ***F21V 17/12*** | (2006.01) |
| ***F21V 19/00*** | (2006.01) |
| ***F21Y 115/10*** | (2016.01) |

(52) U.S. Cl.
CPC ..... *F21V 17/12* (2013.01); *F21V 19/003* (2013.01); *G09F 9/3026* (2013.01); *G09F 9/33* (2013.01); *F21Y 2115/10* (2016.08)

(58) Field of Classification Search
USPC ..... 362/294.04
See application file for complete search history.

(56) References Cited

U.S. PATENT DOCUMENTS

| | | | | |
|---|---|---|---|---|
| 2009/0225546 | A1* | 9/2009 | Pearson | F21S 2/005 362/249.06 |
| 2012/0062151 | A1* | 3/2012 | Lin | F21V 19/0035 315/312 |
| 2015/0062901 | A1* | 3/2015 | Chen | F21V 15/012 362/249.04 |

FOREIGN PATENT DOCUMENTS

| | | |
|---|---|---|
| CN | 203548446 | 4/2014 |
| CN | 103985321 | 8/2014 |
| CN | 104008707 | 8/2014 |
| CN | 143985322 | 8/2014 |
| CN | 144332114 | 2/2015 |
| JP | 2002-333847 | 11/2002 |

* cited by examiner

BENDABLE LED MODULE, CIRCULAR LED MODULE AND WAVY LED MODULE

TECHNICAL FIELD

The present invention relates to a bendable led module, a circular led module and a wavy led module, which relate to a display device technical field.

BACKGROUND

As an outdoor display device, an LED module is generally mounted on a wall or a frame in a plate form to broadcast advertisements or other image. In order to adapt to different mounting environments, and to obtain better visual effect, people often set the LED modules in curved surface forms. For example, Chinese patent CN202549189U discloses an S-shaped LED module, by connecting LED modules on both sides together through a flexible connecting board set on a curved part, the LED module of the patent document can be mounted on a wall with corner. Such an S-shaped LED module may have the following defects: 1. at the corner of the S shape, an U-shaped or V-shaped connecting plate is used to connect the LED modules, the LED module itself can't bend, and is not suitable to close and fit curved walls; the connecting plate can't be used to display images, such that displayed images will be cut off; 2. in assembly, the LED modules on both sides need to be connected with the connecting plate by riveting or welding, therefore mounting is relatively cumbersome and difficult.

In order to solve the technical problem that the S-shaped LED module are not applicable to close the curved walls, the displayed images are cut off, and mounting is difficult, China Patent CN104008707A discloses a arc-fixing rod for a bendable LED display screen, which comprises a flexible screen unit comprising a plurality of LED lamp strips arranged transversely. Two arc-fixing rods are arranged on the top and the bottom of the back of the lamp strip, two mounting bases of each arc-fixing rod are respectively fixed with the LED lamp strips on both sides. Each arc-fixing rod comprises a telescopic rod and the two mounting seats. Two ends of the telescopic rod are respectively hinged with the two mounting seats. The telescopic rod comprises a sliding rod, a sleeve and a locking mechanism. The sliding rod is inserted into the inner hole of the sleeve, and is matched with the inner hole of the sleeve, and the sliding rod is axially fixed by the locking mechanism. But the arc-fixing rod of the bendable LED display may have the following disadvantages: 1. the LED display screen is formed by a plurality of LED lamp strips arranged transversely, a gap is formed between every two LED lamp strips, such gaps will expand when the LED lamp strips are bent into an inner arc, which makes the display effect be worse; 2. the telescopic rod has a tube-in-tube structure, the locking mechanism includes a rotary head and a handle, the telescopic rod is locked in a transverse groove through the handle of the locking mechanism, the angles of the curved display screen are not continuous, the curve of the display screen is a discontinuous curve determined by the number of the transverse grooves and the gaps between the transverse grooves, which makes the applicability be low; 3. the locking mechanism, telescopic rod and column have relatively complex structures, great weights, and high production cost.

SUMMARY

The invention firstly solves the technical problem that the existing bendable LED module has bad display effect, and provides a bendable LED module which has good display effect.

The invention secondly solves the technical problem that the existing bendable LED module has a discontinuous arc and bad applicability, and provides a bendable LED module which has good applicability.

The invention thirdly solves the technical problem that the existing bendable LED module has a relatively complex structure, a great weight, and high production cost, and provides a bendable LED module which has a simple structure, a light weight and low production cost.

To achieve the above purposes, the present invention provides a bendable LED module, which comprises:

an elastic component layer on which a plurality of light emitting assemblies are arranged;

an adjusting part which acts on the back of the elastic component layer and pulls or pushes the two sides of the elastic component layer to bend the elastic component layer into an inner arc or outer arc.

In the above mentioned bendable LED module, two groups of the adjusting parts are respectively disposed on the top and the bottom of the elastic component layer.

In the above mentioned bendable LED module, the adjusting part comprises: fixing members disposed on two sides of the back of the elastic component layer; and an adjusting member connected with the fixing members on the two sides, the adjusting member pulls or pushes the fixing members on the two sides to bend an LED panel and the elastic component layer into the inner arc or outer arc.

In the above mentioned bendable LED module, each fixing member comprises a fixing block, the adjusting member comprises: a screw which is hinged with the fixing block and extends toward the opposite fixing block; and a connecting rod connected with the screws on two sides in a thread connection manner, each of both ends of the connecting rod is provided with a screw hole matched with the screws by thread, and the screws on two sides have different thread directions.

In the above mentioned bendable LED module, an accommodating groove is formed on the fixing block, a inserting portion applicable for entering the accommodating groove is formed on one end of the screws, the inserting portion is provided with a through hole, a pin passes through the top of the fixing block and the through hole to position the fixing block and the screw.

In the above mentioned bendable LED module, the elastic component layer is a carbon fiber plate In the above mentioned bendable LED module, the circular LED module is formed by a plurality of the bendable LED modules bent into the outer arc.

In the above mentioned bendable LED module, adjacent fixing blocks of adjacent bendable LED modules are connected together by thread.

In the above mentioned bendable LED module, the wavy LED module is formed by at least one bendable LED module bent into the inner arc and at least one bendable LED module bent into the outer arc.

In the above mentioned bendable LED module, the adjacent fixing blocks of adjacent bendable LED modules are connected together by thread.

Compared with the prior art, the above technical solutions of the present invention have the following advantages:

1. In the bendable LED module of the present invention, the light emitting components are mounted on the carbon fiber plate which is bendable and suitable for resilient, and the adjusting part makes the carbon fiber plate itself bend and deform within certain ranges, such that larger gaps will not appear between the light emitting components after the carbon fiber plate bends and deforms, which makes the display effect better.

2. In the bendable LED module of the present invention, the adjusting part comprises fixing members which are horizontally or vertically disposed on two sides of the back of the elastic component layer, and the adjusting member connected with the fixing members on the two sides, the adjusting member pulls or pushes the fixing members on the two sides, to bend the LED panel and the elastic component layer into the inner arc or outer arc; the adjusting member pulls or pushes the fixing members to make the carbon fiber plate generate curve with the inner arc or outer arc, such that the bendable LED module of the present invention has a wider application range.

3. In the bendable LED module of the present invention, two screws are respectively hinged with the fixing blocks on both sides, the screw hole on the connecting rod is connected to the screw by thread, and the screws of the screw on two sides have different thread directions. When the connecting rod is rotated forward or inversely, the fixing block is pulled or pushed to make the carbon fiber plate bend into the inner arc or outer arc. Because the thread connection is self-lockable, the connecting rod can maintain any suitable angle. Compared with the adjusting way of the prior art, the above arrangement has a simpler structure, and greatly reduced production cost and weight. Moreover, adjusting the bending angle through the thread can make the bending angles of the carbon fiber plate be continuous, compared with the adjusting way of the prior art which finishes change in a gear manner, the applicability of the present invention is higher.

BRIEF DESCRIPTION OF THE DRAWINGS

In order to make the content of the present invention be understood more clearly, the invention is described in detail further hereafter with reference to the accompanying drawings, wherein.

REFERENCE NUMBER ILLUSTRATION

20—elastic component layer; 30—adjusting part; 31—fixing block; 32—screw; 33—connecting rod.

DETAILED DESCRIPTION OF THE EMBODIMENT

The bendable LED module will be described in detail below with reference to the accompanying drawings.

First Embodiment

Referring to FIGS. 1-4, the bendable LED module comprises: an elastic component layer 20 on which a plurality of light emitting assemblies are arranged; an adjusting part 30 which acts on the back of the elastic component layer 20 and pulls or pushes the two sides of the elastic component layer 20 to bend the elastic component layer 20 into an inner arc or outer arc. The elastic component layer 20 is made of material which is adapted for resilience after bend and deformation, such that large gaps won't appear between the light emitting components after the elastic component layer 20 is bent and deforms, thereby making the display effect better.

In this embodiment, the bendable LED module has three using states, when the adjusting part 30 doesn't provide any adjusting action to the elastic component layer 20, the elastic component layer 20 is plane, and is suitable for transport and storage; when the adjusting part 30 makes the elastic component layer 20 bend into inner arc or outer arc, the bendable LED module can serve as a curved display device.

As a way of implementation, because the carbon fiber has high strength, light weight, and the most important thing is that it has good toughness and resilience, no matter how to bend in a certain scope, it can rebound to its original state, therefore, in this embodiment the carbon fiber material is used for the elastic component layer 20. Apparently, the back board used for bending and rebounding is not limited to the carbon fiber material, it can also be formed from other materials with good toughness and resilience, for example, plastic plates, manganese plates, and glass fiber boards, etc. One of ordinary skill in the art should be able to flexibly select the material of the back board on the basis of the above description combined with the common knowledge in the field.

Figure 1:
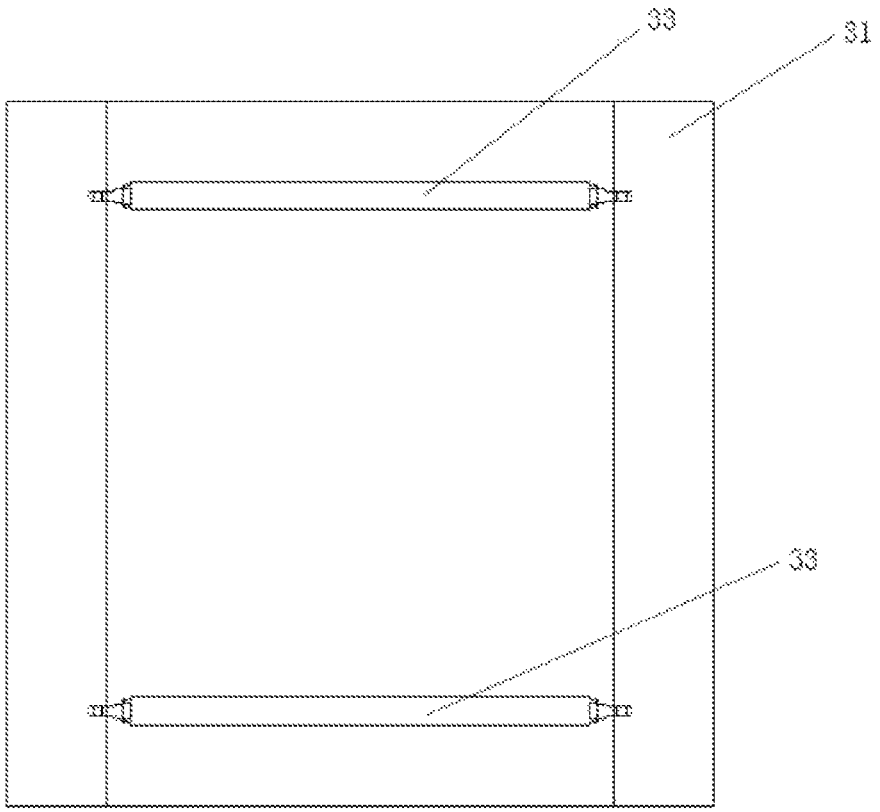
FIG. 1 is a perspective view of a bendable LED module of the present invention.

In this embodiment, referring to FIG. 1, there are two groups of adjusting parts 30, which are respectively disposed on the top and the bottom of the elastic component layer 20, thus it is ensured that the whole LED module may be bent consistently. It can also set 3, 4, 5 or more groups of adjusting parts 30, which are not described one by one here.

Figure 2:
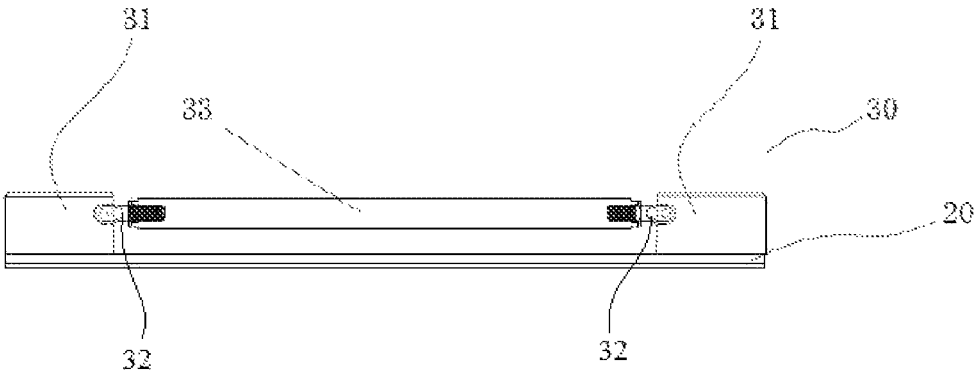
FIG. 2 is a top view of FIG. 1.
Figure 3:
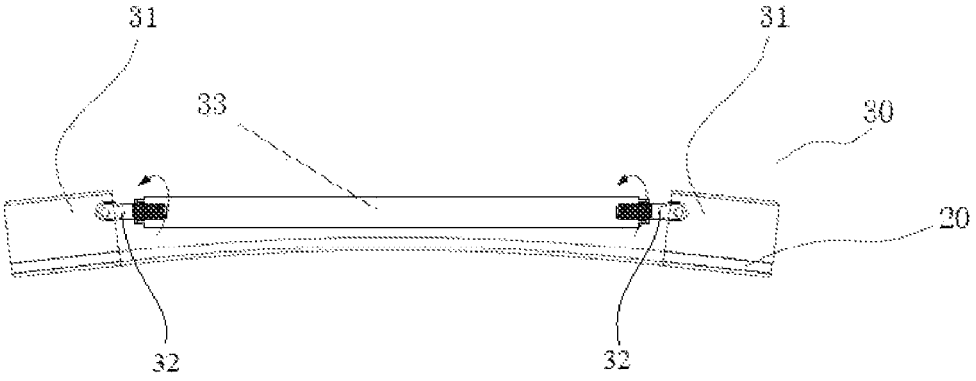
FIG. 3 is a schematic structural view of the bendable LED module of the present invention in an inner arc state.
Figure 4:
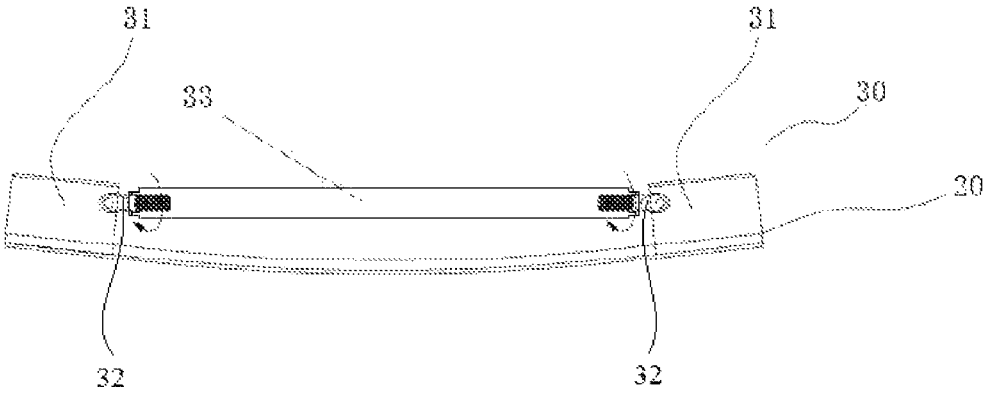
FIG. 4 is a schematic structural view of the bendable LED module of the present invention in an outer arc state.
Figure 5:
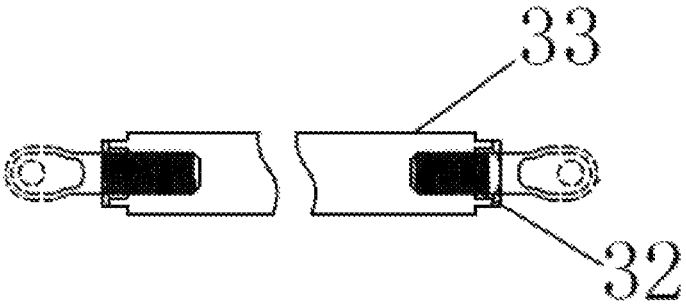
FIG. 5 is a schematic structural view of connecting the connecting rod with the screw.

The arrangement of the adjusting parts 30 in this embodiment is described in detail with reference to FIGS. 2-5:

In this embodiment, referring to FIGS. 2-4, the adjusting part 30 comprises fixing members which are horizontally or vertically disposed on two sides of the back of the elastic component layer 20, and adjusting member connected with the fixing members on the two sides, the adjusting member pulls or pushes the fixing members on the two sides to bend elastic component layer 20 into the inner arc or outer arc, the adjusting member pulls or pushes the fixing members to make the elastic component layer 20 generate curves with an inner arc direction or an outer arc direction, such that the bendable LED module of the present invention has a wider application range.

Furthermore, each fixing member comprises a fixing block 31, the fixing block 31 and the elastic component layer 20 are connected together and fixed by threads; however, the connection manner is not limited, the fixing block 31 and the elastic component layer 20 may be formed integrally, other may maintain a relative fixation through an embedding connection or other connection manners. The adjusting member comprises: a screw 32 which is hinged with the fixing block 31 and extends toward an opposite fixing block 31; and a connecting rod 33 connected with the screws 32 on two sides in a thread connection manner, each of both ends of the connecting rod 33 is provided with a screw hole matched with the screws 32 by thread, and the screws 32 on two sides have different thread directions. Because the screws 32 on two sides have different thread directions, when either of the screw 32 is rotated forward or inversely, the screw 32 can be driven to rotate into or out of the screw hole, such that the fixing block 31 is pulled or pushed. Because the thread connection is self-lockable, the connecting rod 33 can maintain any suitable angle. Compared with the adjusting way of the prior art that the handle is fixed in different vertical grooves, the above arrangement has a simpler structure, and greatly reduced production cost and weight. Moreover, adjusting the bending angle through the thread can make the bending angles of the carbon fiber plate be continuous, compared with the adjusting way of the prior art which finishes change in a gear manner, the applicability of the present invention is higher.

More specifically, referring to FIGS. 2-4, an accommodating groove not shown in the figures is formed on the fixing block 31, an inserting portion applicable for entering the accommodating groove is formed on one end of the screws 32, the inserting portion is provided with a through hole, a pin passes through the top of the fixing block 31 and the through hole to position the fixing block 31 and the screw 32, such that the screw 32 can rotate with respect to the pin. There are a variety of setting ways for the connecting rod 33 to pull or push the fixing block 31 when rotating, the setting way is not limited by the above solution. Although they are not disclosed by the figures, one of ordinary skill in the art can understand them through the following description: specifically, the screw 32 shrinks back or stretches out the screw hole to make the resilience force generated by the deformation of the connecting rod 33 itself pull other push the fixing blocks 31 on the two sides or directly act on the elastic component layer 20, thereby bending the elastic component layer 20 into the inner arc or outer arc.

In this embodiment, the fixing blocks 31 are disposed on two sides of the back of the elastic component layer 20; the fixing blocks 31 may extend on the two sides along a vertical direction to cover the whole elastic component layer 20. During bending adjustment, the fixing blocks 31 drive from the two sides of the elastic component layer 20 to bend the whole elastic component layer 20. The fixing blocks 31 may also be connected to the back of the elastic component layer 20 and appear as masses, such an arrangement makes the bendable LED module have a light weight and be easy to transport and mount.

Second Embodiment

Figure 7:
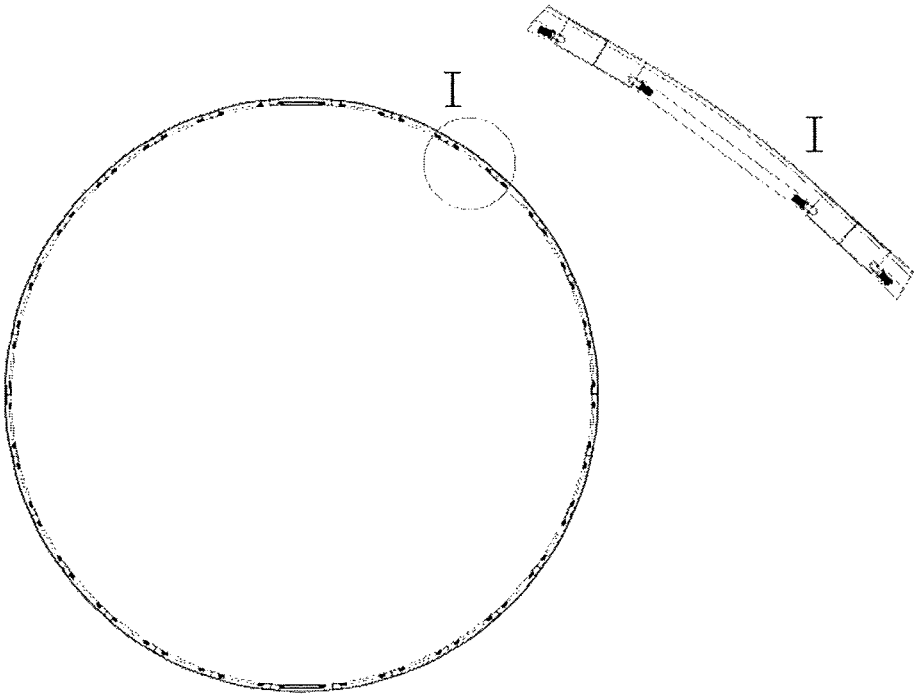
FIG. 7 shows a schematic structural view of a circular LED module of a second embodiment and an enlarged view of adjacent bendable LED modules.

This embodiment provides a circular LED module using the bendable LED module in the first embodiment. Referring to FIG. 7, the circular LED module is formed by a plurality of above-described bendable LED modules bent into the outer arc, and the adjacent fixing blocks 31 of adjacent bendable LED modules are connected together by threads. Clearly, the connection between adjacent fixing blocks 31 of adjacent bendable LED modules is not limited to the thread connection; the connection way may also be, for example, adhesive, riveting, mosaic and so on.

Third Embodiment

Figure 8:
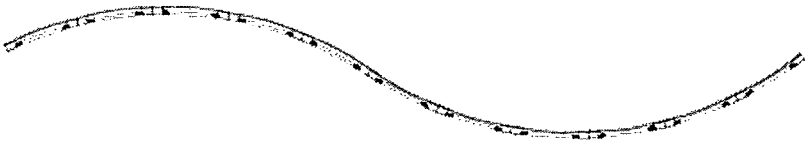
FIG. 8 is a schematic structural view of a wavy LED module of a third embodiment.

This embodiment provides a wavy LED module using the bendable LED module in the first embodiment. Referring to FIG. 8, the wavy LED module is formed by at least one above-described bendable LED modules bent into the inner arc and at least one above-described bendable LED modules bent into the outer arc. The adjacent fixing blocks 31 of adjacent bendable LED modules are connected together by threads. Clearly, the connection between adjacent fixing blocks 31 of adjacent bendable LED modules is not limited to the thread connection; the connection way may also be, for example, adhesive, riveting, mosaic and so on.

Fourth Embodiment

Figure 6:
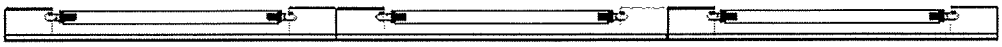
FIG. 6 is a schematic structural view of a plane LED module of a fourth embodiment.

This embodiment provides plane LED module using the bendable LED module in the first embodiment. Referring to FIG. 6, the plane LED module is formed by at least one above-described bendable LED modules which is/are not bent. The adjacent fixing blocks 31 of adjacent bendable LED modules are connected together by a thread. Clearly, the connection between adjacent fixing blocks 31 of adjacent bendable LED modules is not limited to the thread connection; the connection way may also be, for example, adhesive, riveting, mosaic and so on.

Clearly, the above-described embodiments are merely made to clearly illustrate the given examples, and do not intend to limit the implementations. Ordinary skilled person in the art may make other changes or variants in different form based on the above description. It doesn't need to and can not list all embodiments herein. Obvious changes or variants evolved therefrom are still in the protection scope of the invention.

What is claimed is:

1. A bendable LED module, comprising:
- an elastic component layer;
- an adjusting part which acts on a back of the elastic component layer and pulls or pushes two sides of the elastic component layer, to bend the elastic component layer into an inner arc or outer arc,
- wherein the adjusting part comprises:
  - fixing members disposed on two sides of the back of the elastic component layer; and
  - an adjusting member connected with the fixing members on the two sides;
- each fixing member comprises a fixing block,
- the adjusting member comprises:
  - a screw, which is hinged with the fixing block and extends towards the opposite fixing block; and
  - a connecting rod connected with the screw on two sides in a thread connection manner, each of both ends of the connecting rod provided with screw holes matching a threading of the screw, and
  - the screw having two sides, the two sides having different thread directions from one another.

2. The bendable LED module of claim 1, wherein:
- two groups of the adjusting parts are respectively disposed on a top and a bottom of the elastic component layer.

3. The bendable LED module of claim 1, wherein the adjusting member pulls or pushes the fixing members on the two sides, to bend the elastic component layer into the inner arc or outer arc.

4. The bendable LED module of claim 1, wherein the elastic component layer is a carbon fiber plate.

5. A circular LED module using the bendable LED module of claim 1, wherein the circular LED module is formed by a plurality of the bendable LED modules bent into the outer arc.

6. The circular LED module of claim 5, wherein adjacent fixing blocks of adjacent bendable LED modules are connected together by threaded screws.

7. A wavy LED module using the bendable LED module of claim 1, wherein the wavy LED module is formed by at least one bendable LED module bent into the inner arc and at least one bendable LED module bent into the outer arc.

8. The wavy LED module of claim 7, wherein the adjacent fixing blocks of adjacent bendable LED modules are connected together by threaded screws.

* * * * *